US010155406B2

(12) United States Patent
Chrisman

(10) Patent No.: US 10,155,406 B2
(45) Date of Patent: Dec. 18, 2018

(54) GIFT CARD FOLDER

(71) Applicant: Craig R. Chrisman, Christiansburg, VA (US)

(72) Inventor: Craig R. Chrisman, Christiansburg, VA (US)

( * ) Notice: Subject to any disclaimer, the term of this patent is extended or adjusted under 35 U.S.C. 154(b) by 315 days.

(21) Appl. No.: 14/924,860

(22) Filed: Oct. 28, 2015

(65) Prior Publication Data

US 2016/0311595 A1 Oct. 27, 2016

Related U.S. Application Data

(60) Provisional application No. 62/151,452, filed on Apr. 23, 2015.

(51) Int. Cl.

| | |
|---|---|
| ***B65D 73/00*** | (2006.01) |
| ***B42D 15/04*** | (2006.01) |
| ***B42D 5/02*** | (2006.01) |

(52) U.S. Cl.

CPC ..... *B42D 15/045* (2013.01); *B42D 5/027* (2013.01)

(58) Field of Classification Search

CPC ..... B42D 15/02; B42D 15/04; B42D 15/042; B42D 15/045; B42D 15/047; B42D 15/08

USPC ..... 206/768, 756, 763, 45.2, 767, 757; 40/124.08, 539; D9/420

See application file for complete search history.

(56) References Cited

U.S. PATENT DOCUMENTS

| | | | | |
|---|---|---|---|---|
| 5,174,087 A * | 12/1992 | Bruno | ..... | A61B 17/0401 206/63.3 |
| 7,938,270 B2 * | 5/2011 | Davis | ..... | B42D 15/045 206/449 |
| 8,499,478 B1 * | 8/2013 | Glass | ..... | B42D 15/045 40/124.08 |

* cited by examiner

*Primary Examiner* — Steven A. Reynolds
*Assistant Examiner* — Javier A Pagan
(74) *Attorney, Agent, or Firm* — New River Valley IP Law, P.C.; Michele L. Mayberry; Timothy D. Nolan

(57) ABSTRACT

A gift card folder for securing a gift card is described. The gift card folder may be composed of a single sheet of substantially rectangular stationary which has a plurality of creases dividing the single sheet of stationary into panels of which two panels cooperate together to form a pop-up shelf upon manipulation of the gift card folder. A portion of the pop-up shelf comprises one or more slits to secure the gift card in a fixed position during opening or closing of the gift card folder. Further, the gift card folder may optionally include a flap that cooperates with an outer panel to secure the gift card folder in a closed position which compresses the pop-up shelf. When the recipient opens the folder, the gift card folder projects the pop-up shelf outward and towards the recipient of the gift card.

21 Claims, 8 Drawing Sheets

GIFT CARD FOLDER

CROSS-REFERENCE TO RELATED APPLICATIONS

The present application relies on the disclosure of and claims priority to and the benefit of the filing date of U.S. Provisional Application No. 62/151,452, filed on Apr. 23, 2015, the disclosure of which is hereby incorporated by reference herein in its entirety.

BACKGROUND OF THE INVENTION

Field of the Invention

This disclosure relates generally to the field of packaging for gift cards. More particularly, the instant disclosure relates to a gift card folder having a pop-up shelf that projects the gift card from the shelf in a highly visible and attractive manner when the folder is opened. Embodiments of the gift card folder can hold and secure the gift card in a landscape or portrait orientation and secure the gift card folder in a closed position by way of a flap that helps to keep the pop-up shelf compressed in an accordion-like stack.

Description of Related Art

Gift cards are popular gifts, however, they are not always presented in a way that allows the recipient of the gift card to immediately recognize where the gift card can be redeemed or in a way that is personal or fun. Attempts have been made to address this problem, including those described in U.S. Pat. Nos. 6,732,459; 6,966,135; 7,584,558; 7,717,347; 7,938,270; 8,499,478; 8,615,910 and U.S. Patent Application Publication Nos. 20030150142, 20050258060, 20070169388, 20100043262, 2012028586, 20140150307, 20140319021, but as in any art there is need for improvements.

SUMMARY OF THE INVENTION

Embodiments of the invention provide a gift card folder that comprises a pop-up shelf for securing a gift card. When the recipient opens the folder, the gift card folder projects the pop-up shelf outward and towards the recipient of the gift card. Further, in embodiments the gift card folder is adapted to secure and present the gift card in a portrait or landscape orientation and optionally has a flap or cover to close the folder. In this embodiment, one of more slits in the folder are configured to receive one or more portions of a flap or cover to keep the folder in a secured and closed configuration until opened by the recipient of the folder.

In embodiments, the gift card folder comprises a substrate, such as a single sheet of substantially rectangular stationary, comprising a plurality of creases dividing the single sheet of stationary into panels. Two of the panels cooperate together to form a pop-up shelf upon manipulation of the gift card. A portion of the pop-up shelf comprises a pair of separated, opposed slits that are configured for and cooperate together to hold a gift card during opening or closing of the gift card folder.

In embodiments, upon folding the single sheet of stationary three panels cooperate to sandwich the pop-up shelf therebetween and close the gift card folder with one of the three cooperating panels comprising a tapered portion serving as a flap. Another of the three cooperating panels has a pair of slits that are adapted to engage a portion of the flap to retain the gift card folder in a closed position.

In embodiments, the plurality of creases comprise first, second, third, fourth, fifth, and sixth creases which traverse the single sheet of stationary widthwise and divide the sheet into first, second, third, fourth, fifth, sixth, and seventh panels.

In embodiments, a first panel is defined by the first crease and a first edge of the sheet and the seventh panel is defined by the sixth crease and a second edge of the sheet, wherein the seventh panel has a tapered portion such that the second edge of the sheet has a smaller width than the width of the first edge of the sheet.

In embodiments, the single sheet of stationary comprises a rectangular portion. The rectangular portion is divided by the fourth crease such that folding the rectangular portion at the fourth crease in a first configuration brings the first edge of the sheet in proximity to the sixth crease and the first panel in communication with the sixth panel and the fourth panel in communication with the fifth panel.

In embodiments, the folder is configured such that upon folding the rectangular portion at the fourth crease in the first configuration, the first, second, third, and fourth panels overlie the fifth and/or sixth panels.

In embodiments, the second crease is disposed between the second and third panels and folds in a direction that is opposite to the direction in which the first and third creases fold such that the second and third panels are capable of together forming a step when the folder is disposed in the second configuration.

In embodiments, the folder is configured such that folding the fifth panel orthogonal to the sixth panel in a second configuration causes the first panel to lie orthogonal to the fourth panel and the second panel orthogonal to the third panel such that together the second and third panels cooperate to form the pop-up shelf.

In embodiments, in the second configuration the seventh panel bends at the sixth crease to form a canopy over the pop-up shelf.

In embodiments, the second panel and/or third panel have two opposing slits which may be dimensioned to cooperate to hold a gift card in landscape or portrait orientation. The slits may be any shape including straight, curved, or oval. The second panel and/or third panel may have any number of sets of opposing slits, or may have an odd number of slits to allow for the gift card folder to hold a gift card, credit card, business card, etc. in either landscape or portrait as needed. For example, a set of two opposing slits may be configured for holding a card in landscape orientation and a third slit may be included between the two opposing slits to cooperate with one of the first two slits to alternatively hold the card in a portrait orientation.

In embodiments, the folder is configured such that folding the fifth panel to overlie the sixth panel from the second configuration causes the second panel to overlie the third panel such that the pop-up shelf collapses and is sandwiched between the fifth and sixth panel in a third configuration bringing the fifth panel in a position where it can be opposed by the seventh panel and sandwiched between the seventh panel and the sixth panel.

In embodiments, the folder is configured such that the seventh panel represents a flap that can be folded over an outside surface of the fifth panel such that securing the flap to the fifth panel or another panel of the gift card folder, such as the sixth panel, positions the gift card folder in a fourth configuration which represents a closed position.

In embodiments, the fifth panel comprises a pair of opposed slits which are dimensioned to receive a portion of the flap such that the flap can be secured to the fifth panel. Closure of the gift card folder can be configured in any number of ways and can include a single slit for receiving the flap, one or more cooperating hook and loop type fasteners in communication with an interior surface of the flap and an exterior surface of the fifth panel, or a snap-type closure, or a ribbon or tie type closure etc. In embodiments where the outer flap is optional and there is no outer flap, the folder can be secured by communicating any of the remaining panels with one another in a similar manner.

In embodiments, the second and third panels each have a width that is less than the width of each of the first, fourth, fifth, sixth, and seventh panels. The second and third panels are approximately of equal width.

In embodiments, the fifth and sixth panels are of approximately equal width and each has a width that is wider than each of the first, second, third, fourth, and seventh panels.

These and other embodiments will be shown in the accompanying Figures and will be described in the foregoing Detailed Description of the Invention.

BRIEF DESCRIPTION OF THE DRAWINGS

The accompanying drawings illustrate certain aspects of embodiments of the present invention, and should not be used to limit or define the invention. Together with the written description the drawings serve to explain certain principles of the invention.

DETAILED DESCRIPTION OF THE INVENTION

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

Embodiments of the invention provide a gift card folder that can be folded into multiple configurations, including a closed configuration in which the gift card is concealed, and one or more open configurations in which the gift card is presented. The gift card folder is provided as a generally rectangular piece of stationary having an inner surface and an outer surface and a plurality of parallel creases or fold lines which divide the gift card folder into panels that play a role in the presentation or concealment of the gift card upon folding and unfolding. Additionally, the panels have varying widths. Further, at least three creases may be configured to alternate so that they bend in different directions (e.g., a first crease in the series folds upward, while the second crease in the series folds downward, and the third crease in the series folds upward; or downward, upward, and downward). By altering the direction of the bend of the creases, at least two panels may form a pop-up shelf or step upon opening the gift card folder from the closed configuration. Further, these panels may represent an inner portion of the gift card folder that holds the gift card in place when closed. When in such closed configuration, the inner portion of the gift card may close in a compressed accordion-like stack. Slits for receiving the gift card, such as a pair of opposed slits, may hold the gift card in place in a portrait or landscape orientation in a portion of the pop-up shelf. Further, the slits can be configured to hold the gift card so that it is held in such orientation that a user can read the gift card. Further, the slits may be configured to hold the gift card in place during opening and closing of the gift card folder. An additional advantage is provided by an end panel that may be tapered that can function as a flap to hold the folder in a closed position and help retain the gift card. The flap can be secured with a piece of ribbon or tape, or in some embodiments, by tucking or interlocking a portion of the flap into one or more slits, such as a second pair of slits of another outer panel. By interlocking the two outer panels, the gift card can be closed despite the tendency for the compressed accordion-like stack to open. Further, the tapered end panel can function as a covering or canopy of the gift card when it is in an opened configuration.

Figure 1:
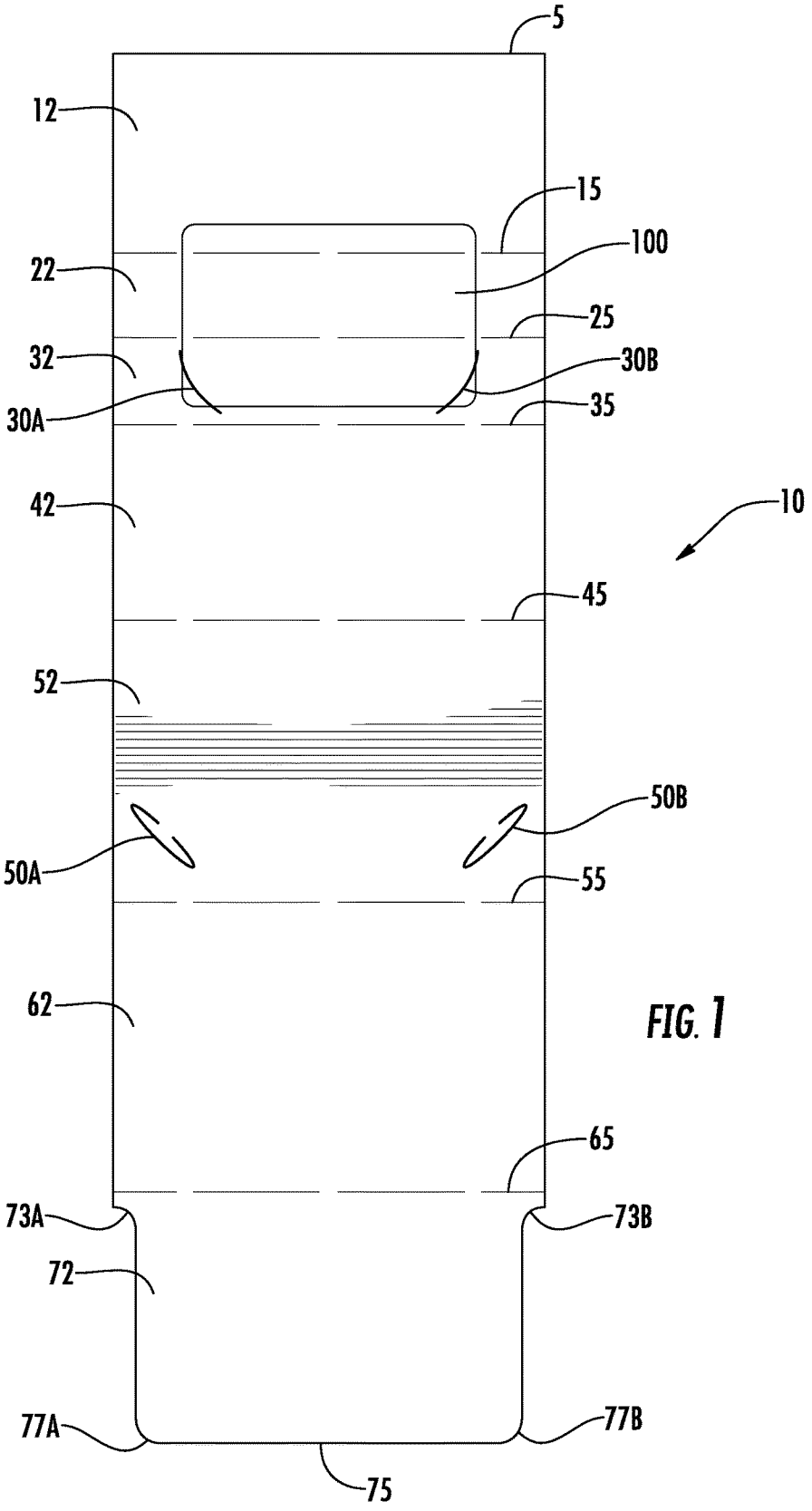
FIG. 1 is a drawing showing a front view of an embodiment of the gift card folder with the substrate in an unfolded configuration.

Turning now to the figures, FIG. 1 shows an embodiment of a gift card folder in an unfolded configuration. Gift card folder 10 comprises, consists of, or consists essentially of a generally rectangular portion of cardstock, thick construction paper, or other stationary, which has a plurality of laterally disposed fold lines or creases spaced apart along its length thus dividing the gift card folder into a plurality of panels. Specifically, six parallel fold lines 15, 25, 35, 45, 55, and 65 divide the gift card folder 10 into seven panels 12, 22, 32, 42, 52, 62, and 72. A first set of three fold lines 15, 25, 35 are spaced closer together than the other fold lines relative to one another. Fold lines 15, 25, and 35 together define three panels 12, 22, and 32. In embodiments, panels 22 and 32 are of equal or approximately equal dimensions. The second set of three fold lines 45, 55, and 65 define four panels 42, 52, 62, and 72, which panels have widths greater than the widths of panels 22 and 32. Further, panels 52 and 62 have the greatest area and are of approximately equal dimensions. Panel 72 is disposed at an end of the folder 10 that opposes the end of the folder where panel 12 is disposed. As shown in the figure, panel 72 is specifically configured to taper slightly in at curves 73A and 73B beyond the last fold line 65 and form a flap with corners 77A and 77B, which in this embodiment are cured, but can also be square. Also notable are one or more slits in various panels of the folder. The slits are configured for holding a gift card in the folder and for retaining the folder in a closed position. For example, a set of two opposed slits 30A and 30B in panel 32 are configured for placement of a gift card 100 as shown in the figure. However, in other embodiments, the slits 30A and 30B are in panel 22 or 12. Further, in other embodiments, the slits 30A and 30B may be straight, or may be a single slit for receiving an edge of the gift card. The slits may be of any shape that is adapted to secure a gift card, such as at least a corner portion of the gift card. Further, in embodiments the slits are dimensioned to cooperate to hold the gift card in a portrait or landscape orientation at the corners of the gift card. An additional slit or slit can be configured for retaining the gift card in a closed position, such as slits 50A and 50B in panel 52. These slit(s) can be any shape as well and here are shown as C-shaped or oval. Also shown are edges 5 and 75 representing the ends of the gift card folder 10.

As will be shown in the following figures, parallel fold lines or creases 15, 25, 35, 45, 55, 65 allow gift card folder 10 to be transformed from a two-dimensional sheet to one or more three-dimensional configurations which include a closed configuration in which the gift card is packaged and hidden and one or more open configurations in which the gift card is displayed. By folding the gift card folder at fold line 45, panels 12, 22, 32, and 42 will generally define an inner portion of the gift card folder that cooperate to form a pop-up shelf that projects outward presenting the gift card to a recipient, and panels 52, 62, and 72 will define an outer portion of the gift card folder that are involved in concealing the gift card when folded together along fold lines 55 and 65. When completely folded in a closed configuration, panels 12, 22, 32, and 42 collapse together in an accordion-like stack surrounded by panels 52, 62, and 72. Adhesive may be used to keep the folder in a specific form, such as by securing panel 42 to panel 52 with adhesive once folded, and by securing panel 12 to panel 62 with adhesive.

The unfolded configuration shown in FIG. 1 can be used as a die line in the manufacture of the gift card folder. In one embodiment, the gift card folder can be manufactured in the following dimensions shown in Table 1.

TABLE 1

Exemplary Dimensions of Gift Card Folder

| Feature | Length |
|---|---|
| Length of Edge 5 | 5 inches |
| Distance from Edge 5 to Fold Line 15 | 2 and 5/16 inches |
| Distance from Fold Line 15 to Fold Line 25 | 1 inch |
| Distance from Fold Line 25 to Fold Line 35 | 1 inch |
| Distance from Fold Line 35 to Fold Line 45 | 2 and 1/4 inches |
| Distance from Fold Line 45 to Fold Line 55 | 3 and 1/4 inches |
| Distance from Fold Line 55 to Fold Line 65 | 3 and 3/8 inches |
| Distance from Fold Line 65 to Edge 75 | 2 and 15/16 inches |
| Length of Edge 75 | 4 and 1/2 inches |

Dimensions of the above features may deviate from the above specifications by plus or minus 1% to 25%, including 2%, 3%, 4%, 5%, 6%, 7%, 8%, 9%, 10%, 11%, 12%, 13%, 14%, 15%, 16%, 17%, 18%, 19%, 20%, 21%, 22%, 23%, and 24%. However, the gift card folder should be of sufficient size to package a standard gift card, when folded (as shown in the following figures). Standard gift cards have the same dimensions as credit cards (3⅜" (width)×2⅛" (height)). Thus, distance from curved slits 30A and 30B should be relatively constant so that a standard gift card can be held in place by the slits. Indeed, the folder can be sized for any application and the relative dimensions of the panels and edges used as a guide in increasing or decreasing the size of the folder to accommodate a desired use. With regards to thickness of the stationary, generally cardstock in the range of 100-200 grams per square meter (gsm), including 100-120 gsm, 120-150 gsm, and 150-200 gsm may be used. Additionally, the stationary used to form gift card folder 10 may be optionally printed with decorative patterns. For example, outer panels 52, 62, and 72 may be printed with patterns similar to those used in wrapping paper for presents and inner panels may be similarly printed and may have the same or different pattern than outer panels. The folder can be made of any material, such as fabric, plastic, metal, cardboard, paper, foil, or any suitable substrate for a desired application.

Figure 2:
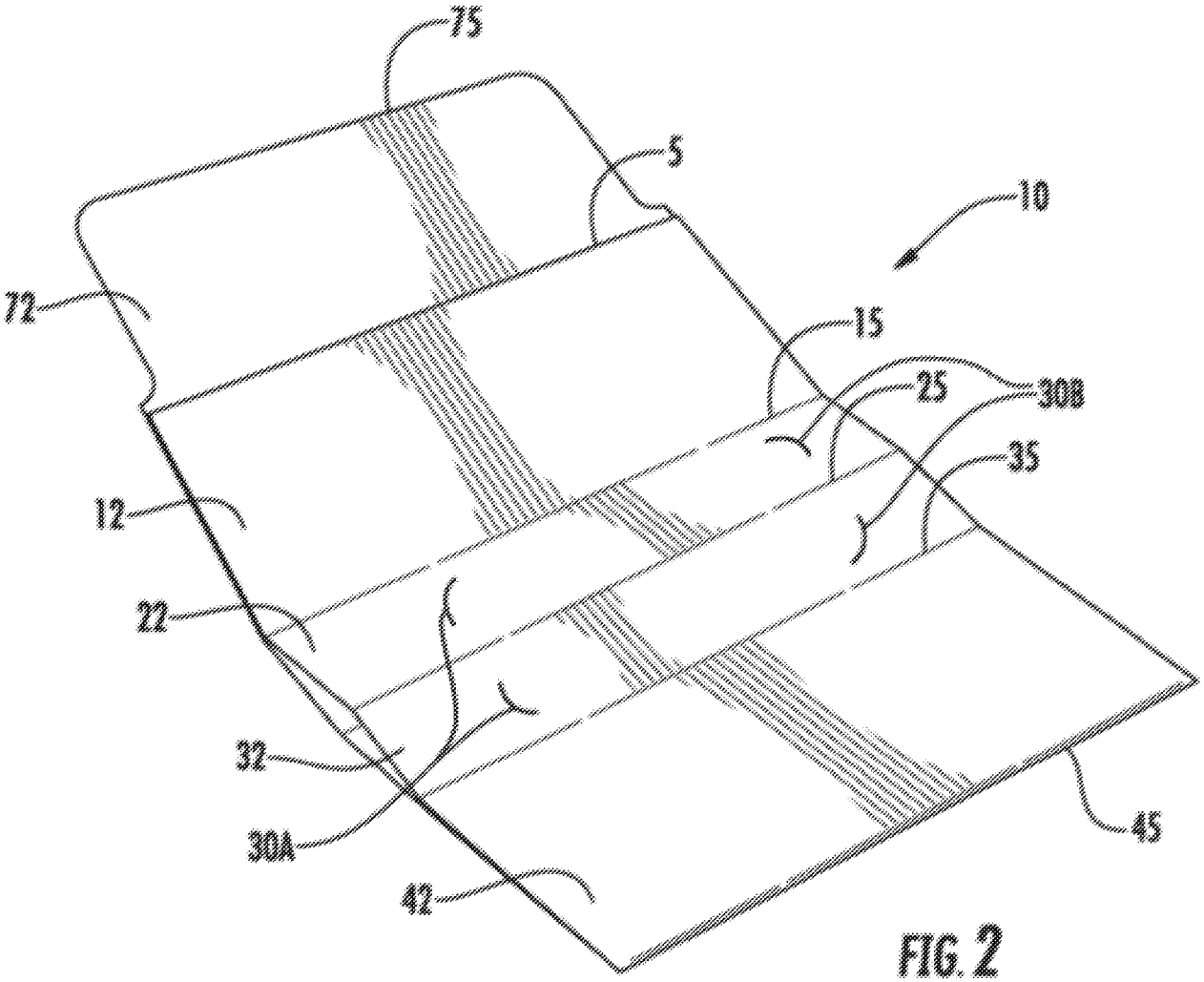
FIG. 2 is a drawing showing a perspective view of the gift card folder with the substrate in a folded, open configuration.

Turning now to FIG. 2, an embodiment of a gift card folder 10 is shown in which the folder is first oriented 180 degrees so that panel 72 represents the top of the folder. The gift card folder is then folded approximately in half along fold line 45 so that the portion below fold line 45 is folded upward so that edge 5 of folder meets fold line 65 (not shown). In this case, panels 12, 22, 32, and 42 now cover panels 52 and 62 (not shown) and define an inner portion of the folder 10. In this configuration it may be desirable to secure panel 42 to panel 52 and to secure panel 12 to panel 62 using adhesive. FIG. 2 also shows that fold line 25 is configured to bend upward while fold lines 15 and 35 are configured to bend downward. As a result, panels 22 and 32 are capable of together forming a step, otherwise referred to as a pop-up shelf, when the folder is provided in the configuration shown in FIG. 8.

In the configuration shown in FIG. 2, a gift card (not shown) may be placed by a user of the gift card folder so that the bottom corners of the gift card are held by curved slits 30A and 30B, which are dimensioned to cooperate to hold gift card at the corners. Additionally, the user may write a note on the visible portions of the gift card. Alternatively, a manufacturer or retailer may place the gift card in the folder using the curved slits 30A and 30B to secure it. At this point, the gift card folder 10 can be further folded to a closed state to secure and conceal the gift card.

Figure 3:
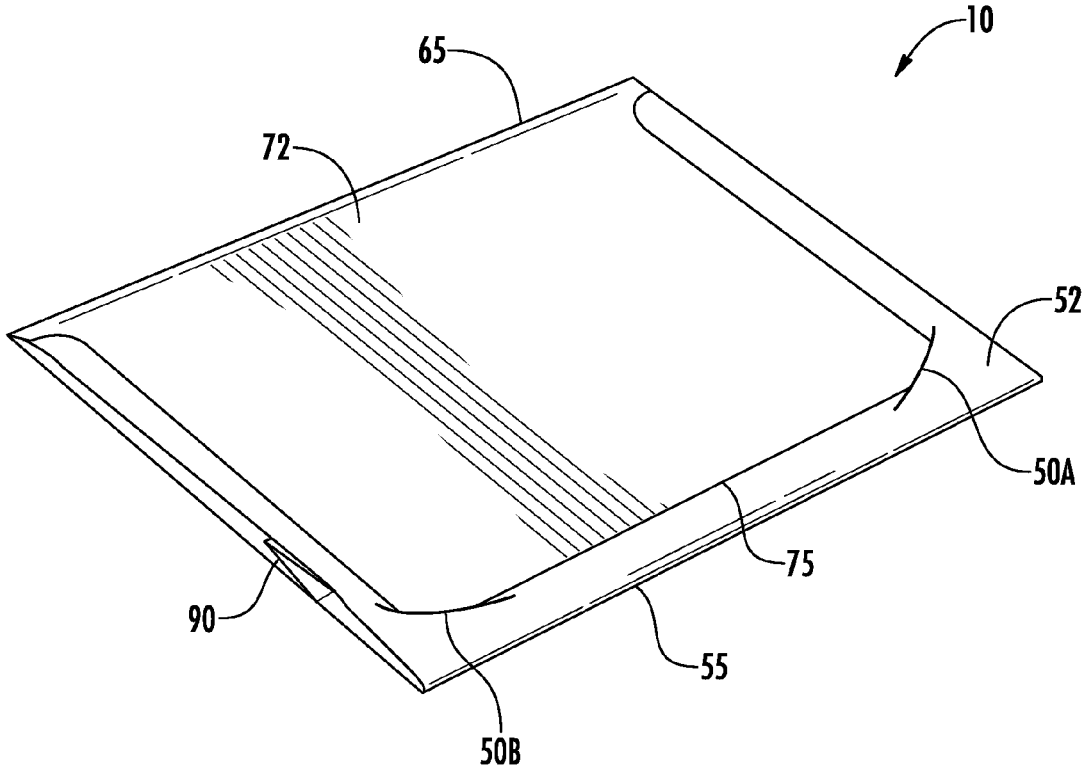
FIG. 3 is a drawing showing a perspective view of the gift card folder with the substrate in a folded, closed configuration with the top flap inserted into coordinating slits.

FIG. 3 shows the gift card folder 10 in a closed state. From the configuration shown in FIG. 2, two steps are used to obtain the configuration shown in FIG. 3. First, the gift card folder is folded inward again at fold line 55 so that panel 52 is folded downward over panels 12, 22, 32 and 42 so that they fold like an accordion. A portion of these inner folded portions is shown by reference number 90. As a result, panels 62 and 52, which have approximately equal dimensions, form outer portions of the folder which sandwich in panels 12, 22, 32, and 42. Panel 52 can be of any dimensions but is preferably smaller in dimension than panel 62. Next, the flap 72 is folded over panel 52 at fold line 65 so that it communicates with panel 52 to close the folder. For example, the corners of panel 72 can be tucked into one or more slits in panel 52, such as slits 50A and 50B. Folding and tucking this flap 72 in slits 50A and 50B effectively seals the gift card folder so that it can be presented to a gift recipient and keeps compressed accordion-like stack 90 of inner panels 12, 22, 32 and 42 from expanding (which in some embodiments have a tendency to unfold when not compressed).

Figure 4A:
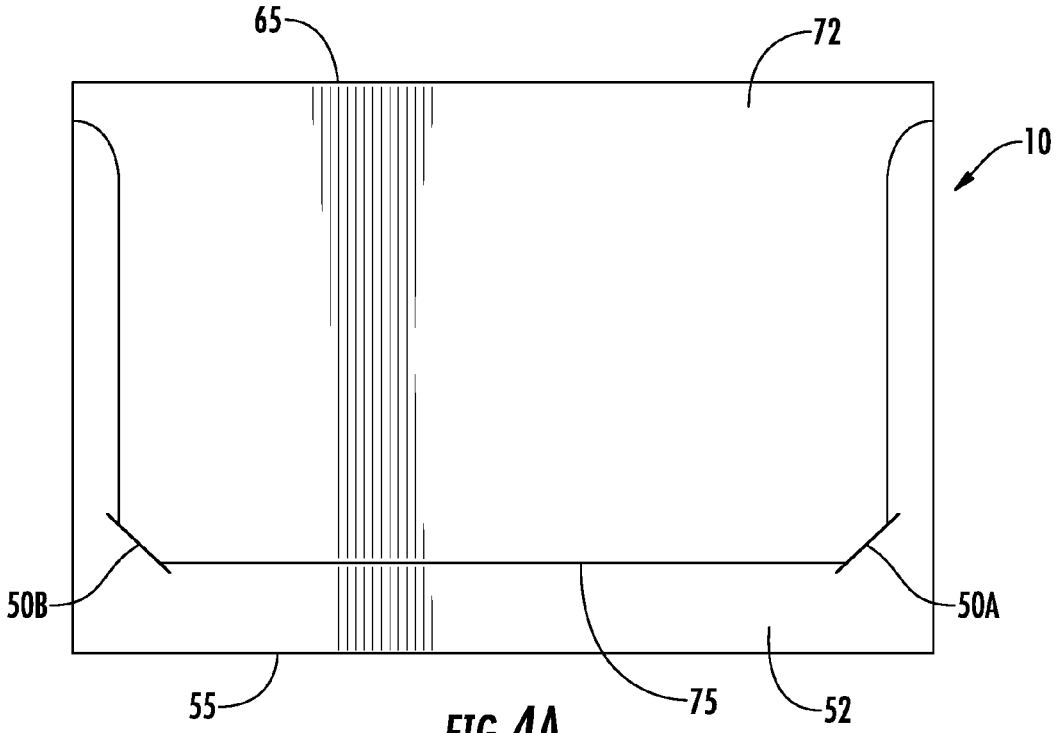
FIG. 4A is a drawing showing a front view of the folder in a closed configuration.
Figure 4B:
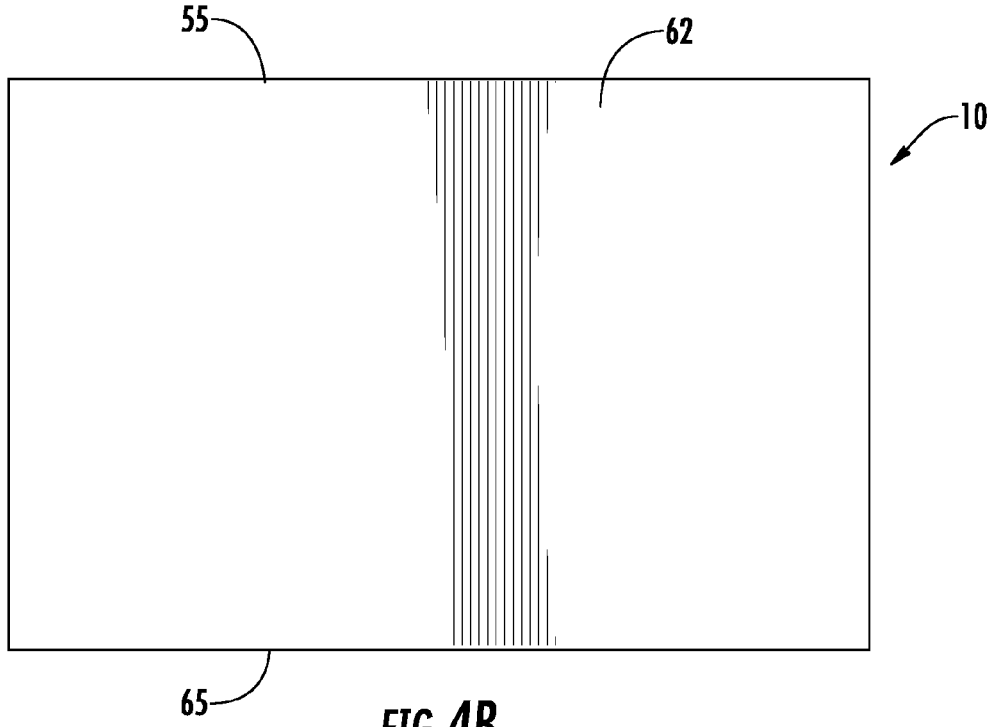
FIG. 4B is a drawing showing a rear view of the folder in a closed configuration.

FIGS. 4A and 4B show an embodiment of a gift card folder in a closed configuration. As shown from the top view of FIG. 4A, flap 72 is folded down so that the corners of the flap are tucked and secured in slits 50A and 50B of panel 52 which are dimensioned to cooperate to secure the corners of the flap. The slits can be of any shape such as curved, oval, straight, square, rectangular, or triangular. Bottom view shows panel 62 which has no slits.

Figure 5A:
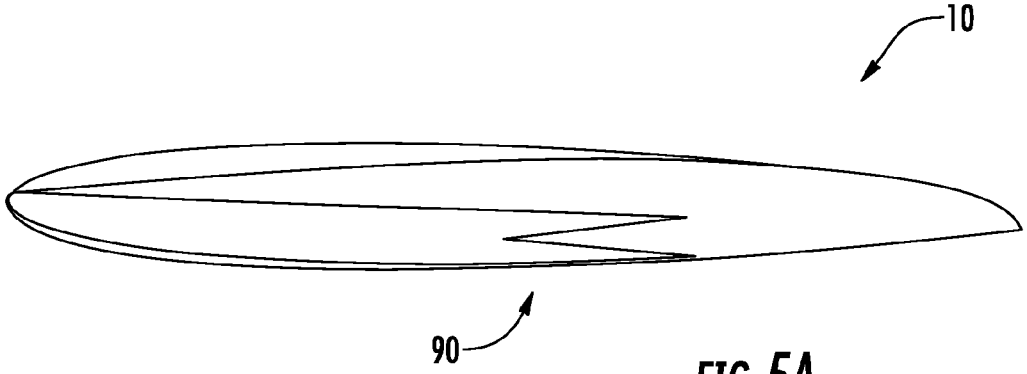
FIG. 5A is a drawing showing a side view of the gift card folder with the substrate folded in a closed configuration without a gift card.
Figure 5B:
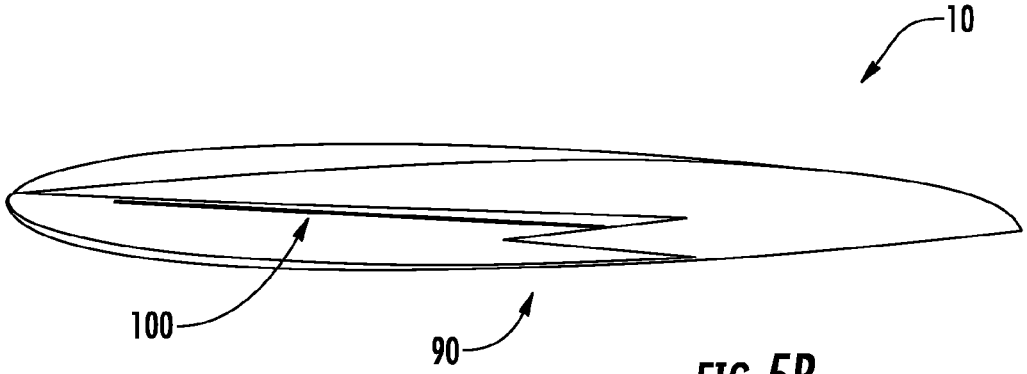
FIG. 5B is a drawing showing a side view of the gift card folder with the substrate folded in a closed configuration with a gift card.

FIG. 5A is a side view of the folder 10 in a closed configuration without a gift card. FIG. 5B is a side view of the folder 10 in a closed configuration with a gift card 100. Notable in these figures is accordion-like stack 90 in the center of the folder formed by inner panels 12, 22, 32, and 42 of the folder. As shown in FIG. 5B, the gift card 100 is secured within the accordion-like stack 90.

Figure 6B:
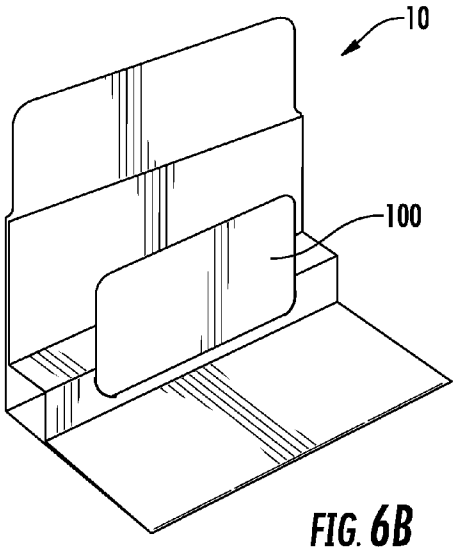
FIG. 6B is a drawing showing a perspective view of the folder in an open configuration showing the pop-up shelf with a gift card.
Figure 6A:
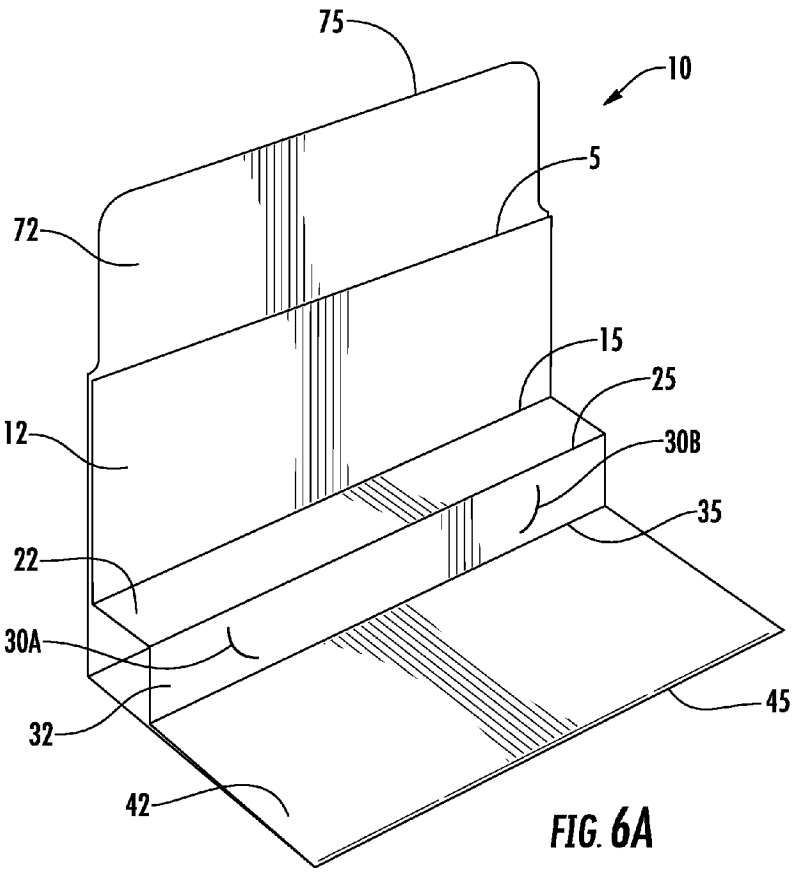
FIG. 6A is a drawing showing a perspective view of the folder in an open configuration showing the pop-up shelf without a gift card.
Figure 7B:
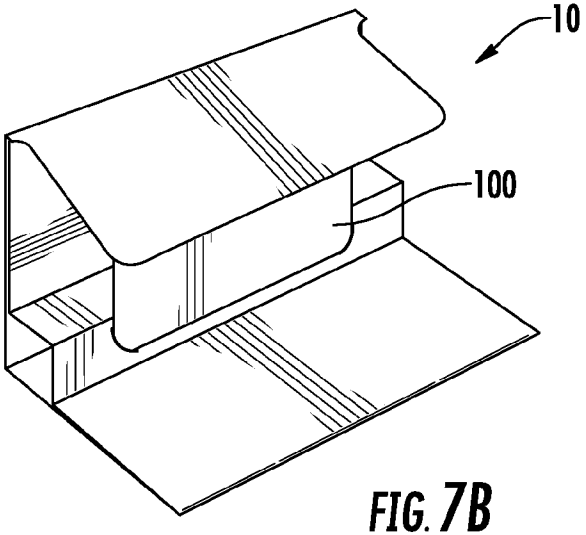
FIG. 7B is a drawing showing a perspective view of the folder in an open configuration showing the pop-up shelf with a gift card and the top flap partially closed.
Figure 7A:
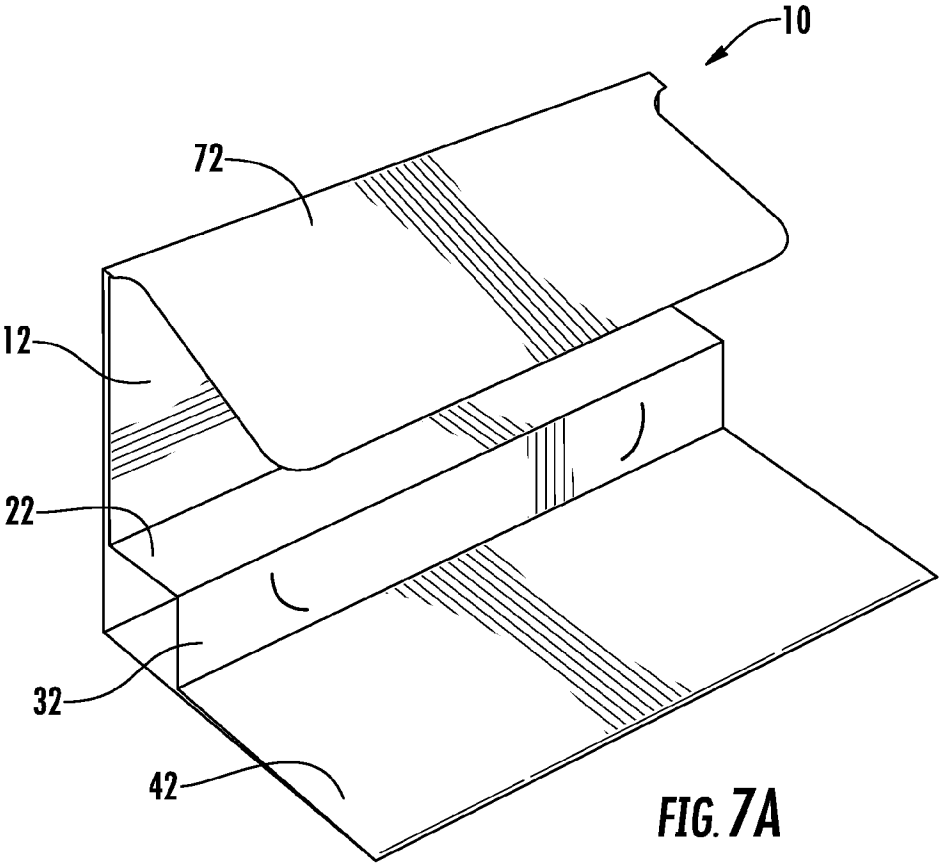
FIG. 7A is a drawing showing a perspective view of the folder in an open configuration showing the pop-up shelf without a gift card and the top flap partially closed.
Figure 8:
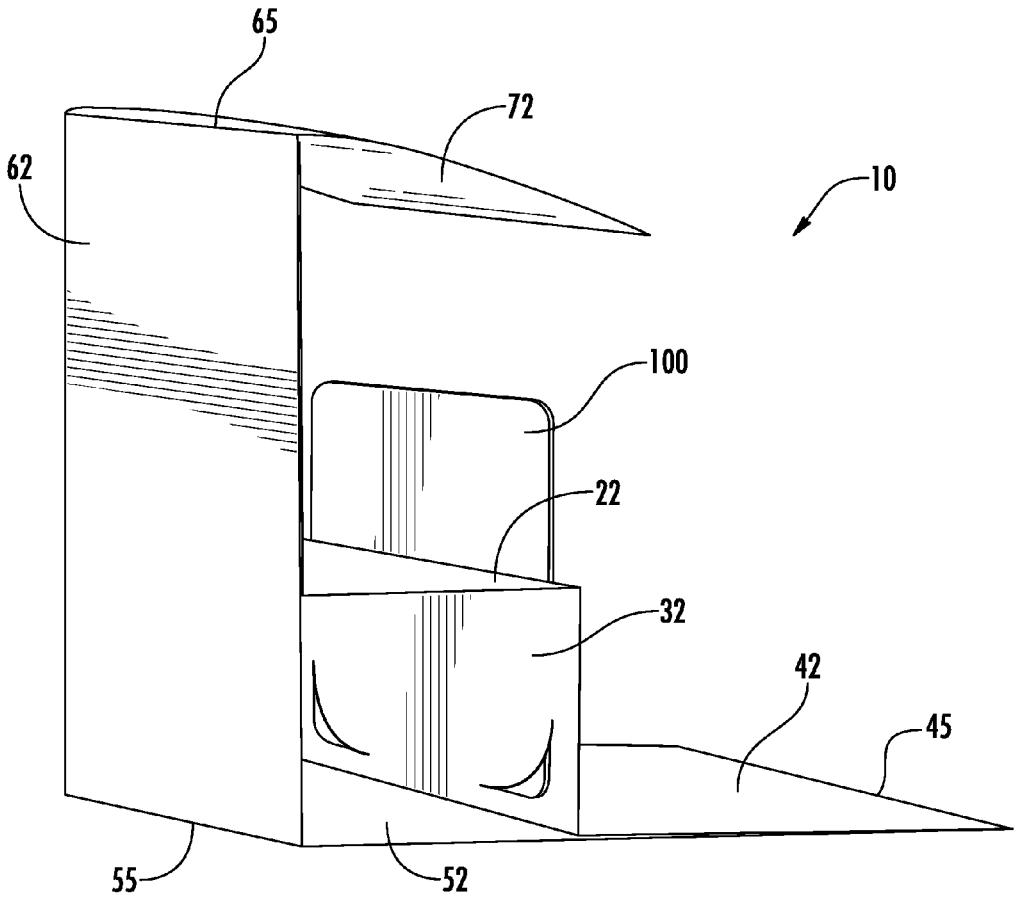
FIG. 8 is a drawing showing a rear perspective view of the folder in an open configuration showing the gift card secured in the pop-up shelf.

FIGS. 6A-B, 7A-B, and 8 show an open folder configuration obtained from the configuration in FIG. 2. To obtain this configuration, panels 52 and 62 are bended orthogonal to each other at fold line 55 (shown in FIG. 8). As a result, inner panels produce a stepped configuration wherein panels 12 and 22, 22 and 32, and 32 are 42 are orthogonal to each other (shown in FIG. 6A) so that panel 42 forms a "floor", panels 22 and 32 form a pop-up "shelf" or "step", and panel 12 forms a "wall" orthogonal to the floor 42. FIG. 7A shows that panel 72 can be folded downward at an angle to form a "canopy" or "awning" over the gift card 100. FIG. 6A is equivalent to FIG. 6B, and FIG. 7A is equivalent to FIG. 7B, except that FIGS. 6B and 7B show the gift card 100 in place. As shown in FIGS. 6B and 7B, gift card 100 is presented vertically and in landscape orientation in these configurations of the gift card folder. FIG. 8 shows flap or canopy 72, outer panels 52 and 62, and inner panels 22, 32, and 42 of gift card folder with gift card 100 held in place.

The present invention has been described with reference to particular embodiments having various features. In light of the disclosure provided above, it will be apparent to those skilled in the art that various modifications and variations can be made in the practice of the present invention without departing from the scope or spirit of the invention. For example, embodiments of the gift card folder that comprise more than one sheet of stationary may fall within the scope of the invention. One skilled in the art will recognize that the disclosed features may be used singularly, in any combination, or omitted based on the requirements and specifications of a given application or design. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. When an embodiment refers to "comprising" certain features, it is to be understood that the embodiments can alternatively "consist of" or "consist essentially of" any one or more of the features. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A gift card folder comprising:

a substrate with a plurality of creases or folding indicators for dividing the substrate into a plurality of panels;

wherein the plurality of panels comprises at least a first panel, a second panel, a third panel and a fourth panel, and the second and third panels are configured to cooperate together to form a pop-up shelf when the substrate is folded in a specific configuration;

wherein one or both of the second and/or third panels comprises two or more slits in a face of the panel configured to secure a gift card in a fixed position within the two or more slits during opening or closing of the gift card folder by way of the two or more slits together contacting three edges of the gift card.

2. The gift card folder of claim 1, wherein the plurality of panels further comprises a flap that is adapted to secure the gift card folder in a closed position upon closing the gift card folder.

3. The gift card folder of claim 2, wherein the flap has a tapered portion.

4. The gift card folder of claim 2, wherein a fifth panel of the plurality of panels comprises one or more slits that are dimensioned to engage a portion of the flap.

5. The gift card folder of claim 1, wherein the plurality of creases or folding indicators comprises first, second, third, fourth, fifth, and sixth creases or folding indicators for dividing the substrate into the first, second, third, and fourth panels, and fifth, sixth, and seventh panels.

6. The gift card folder of claim 5, wherein the first panel is defined by the first crease or folding indicator and a first edge of the substrate and the seventh panel is defined by the sixth crease or folding indicator and a second edge of the substrate, wherein the seventh panel has a tapered portion such that the second edge of the substrate has a width that is smaller than a width of the first edge of the substrate.

7. The gift card folder of claim 1, wherein the plurality of panels comprises at least six consecutive panels and the plurality of creases or folding indicators comprises at least five consecutive creases or folding indicators, such that folding the substrate in a first configuration at a fourth crease or folding indicator places a first panel in communication with a sixth panel and a fourth panel in communication with a fifth panel.

8. The gift card folder of claim 1, wherein the plurality of panels comprises at least six consecutive panels and the plurality of creases or folding indicators comprises at least five consecutive creases or folding indicators.

9. The gift card folder of claim 8, wherein the plurality of panels and the plurality of creases or folding indicators comprise the first panel, a first crease or folding indicator, the second panel, a second crease or folding indicator, the third panel, a third crease or folding indicator, the fourth panel, a fourth crease or folding indicator, a fifth panel, a fifth crease or folding indicator, and a sixth panel in that order.

10. The gift card folder of claim 9, wherein:

the second crease or folding indicator is disposed between the second panel and the third panel; and the second crease or folding indicator is capable of folding in a direction opposite that of the first crease or folding indicator and the third crease or folding indicator, such that the second panel and the third panel are together capable of forming a pop-up shelf.

11. The gift card folder of claim 10, wherein folding the substrate in a second configuration provides:

the first panel disposed orthogonal to the fourth panel;

the second panel disposed orthogonal to the third panel and presented as the pop-up shelf; and the fifth panel disposed orthogonal to the sixth panel.

12. The gift card folder of claim 1, wherein the fixed position within the two or more slits results in the gift card contacting both a front and a back face of the second panel or both a front and a back face of the third panel.

13. A gift card folder comprising:

a substrate with a plurality of panels and a plurality of creases or folding indicators;

wherein two cooperating panels of the plurality of panels are capable of together forming a pop-up shelf upon folding of the substrate into a first configuration;

wherein one or both of the two cooperating panels has a panel face with two or more slits capable of holding a gift card in a fixed position within the two or more slits in landscape or portrait orientation during opening or closing of the gift card folder by way of the two or more slits together contacting three edges of the gift card; and wherein, upon folding the substrate into a second configuration, two outermost panels of the plurality of panels, one of which is a flap, together cooperate to sandwich at least three panels of the plurality of panels therebetween, including the two cooperating panels of the pop-up shelf and an end panel in communication with one of the two cooperating panels of the pop-up shelf.

14. The gift card folder of claim 13, wherein the flap comprises a tapered portion and the end panel comprises one or more slits adapted to engage the tapered portion of the flap to retain the gift card folder in a closed state.

15. A gift card folder comprising:

a substrate with first, second, third, fourth, fifth, and sixth creases or folding indicators for dividing the substrate into first, second, third, fourth, fifth, sixth, and seventh panels;

wherein the first panel is disposed at one end of the substrate and is defined in part by the first crease or folding indicator;

wherein the seventh panel comprises a tapered portion, is disposed at an opposing end of the substrate, and is defined in part by the sixth crease or folding indicator; and wherein the second panel and/or the third panel has a panel face with two or more slits dimensioned to hold a gift card in landscape or portrait orientation in a fixed position within the one or more slits during opening and closing of the gift card folder by way of the two or more slits together contacting three edges of the gift card.

16. The gift card folder of claim 15, wherein the fourth crease or folding indicator is disposed on the substrate such that folding the substrate at the fourth crease or folding indicator in a first configuration brings a face of the first panel in communication with a face of the sixth panel.

17. The gift card fold of claim 15, wherein the second crease or folding indicator is disposed between the second panel and the third panel and the second crease or folding indicator folds in a direction opposite that of the first crease or folding indicator and the third crease or folding indicator such that the second and third panels together are capable of forming a pop-up shelf when the substrate is folded in a specific configuration.

18. The gift card folder of claim 15, wherein the substrate is configured such that folding the substrate in a second configuration where the fifth panel is in a position orthogonal to the sixth panel causes the first panel to be disposed orthogonal to the fourth panel, and the second panel to be disposed orthogonal to the third panel, such that the second panel and the third panel cooperate with the first panel and the fourth panel to form a pop-up shelf that projects outward.

19. The gift card folder of claim 18, wherein in the second configuration, the seventh panel is capable of bending at the sixth crease or folding indicator to form a canopy over the pop-up shelf.

20. The gift card folder of claim 19, wherein the fifth panel has a panel face with one or more slits dimensioned to engage a portion of the seventh panel to retain the gift card folder in a closed position.

21. The gift card folder of claim 20, wherein the one or more slits in the panel face of the second panel, the third panel and/or the fifth panel are provided by a pair of slits.

* * * * *